US008628334B2

(12) United States Patent
Kibby et al.

(10) Patent No.: US 8,628,334 B2
(45) Date of Patent: Jan. 14, 2014

(54) PORTABLE WALKING TRAINER DEVICE FOR CHILDREN

(76) Inventors: Edwin Kibby, San Jose, CA (US); Agymah Dyer, Oakland, CA (US); Justine Gomez, San Jose, CA (US)

( * ) Notice: Subject to any disclaimer, the term of this patent is extended or adjusted under 35 U.S.C. 154(b) by 23 days.

(21) Appl. No.: 13/526,150

(22) Filed: Jun. 18, 2012

(65) Prior Publication Data

US 2012/0322039 A1 Dec. 20, 2012

Related U.S. Application Data

(60) Provisional application No. 61/497,573, filed on Jun. 16, 2011.

(51) Int. Cl.
*G09B 19/00* (2006.01)

(52) U.S. Cl.
USPC ..... 434/255

(58) Field of Classification Search
USPC ..... 434/247, 250, 255, 258; 482/41, 42
See application file for complete search history.

(56) References Cited

U.S. PATENT DOCUMENTS

| | | | | |
|---|---|---|---|---|
| 2,682,402 | A * | 6/1954 | McCarthy | 482/135 |
| 4,902,000 | A | 2/1990 | Starks | |
| 4,988,092 | A * | 1/1991 | Trout | 482/51 |
| 5,169,362 | A * | 12/1992 | Schwartz | 482/96 |
| 5,842,960 | A * | 12/1998 | Yu | 482/131 |
| 6,168,548 | B1 * | 1/2001 | Fleming | 482/23 |
| 6,343,390 | B1 | 2/2002 | Yang | |
| 6,421,850 | B1 | 7/2002 | Welsh, Jr. | |
| D522,933 | S * | 6/2006 | Monaghan | D12/130 |
| 7,115,071 | B1 * | 10/2006 | Sunbeck | 482/8 |
| 7,713,175 | B2 | 5/2010 | Monaghan | |
| D635,632 | S * | 4/2011 | Rymniak | D21/791 |
| D686,287 | S * | 7/2013 | Boatwright | D21/691 |
| 2009/0029330 | A1 * | 1/2009 | Moran | 434/255 |
| 2012/0295239 | A1 * | 11/2012 | Gabara et al. | 434/258 |

* cited by examiner

*Primary Examiner* — Kurt Fernstrom
(74) *Attorney, Agent, or Firm* — Daniel Boudwin; Global Intellectual Property Agency LLC

(57) ABSTRACT

A portable walking trainer device for a child, having a U-shaped structure of support bars that are removably securable to a padded base mat. The padded base mat has apertures disposed along its perimeter to facilitate removable securement of the support bars to the mat. Securing posts attached to the support bars are inserted into the apertures, resulting in a stable set of handrails for a child to pull on, lean upon, or use for balance. All support bars are padded to reduce the risk of injury to a child user. When the device is not in use the support bars may be disassembled and fold up within the base mat. Handles disposed at the ends of the base mat allow the self-contained stowed device to be easily transported by a parent or caregiver.

13 Claims, 4 Drawing Sheets

PORTABLE WALKING TRAINER DEVICE FOR CHILDREN

CROSS REFERENCE TO RELATED APPLICATION

Figure 1:
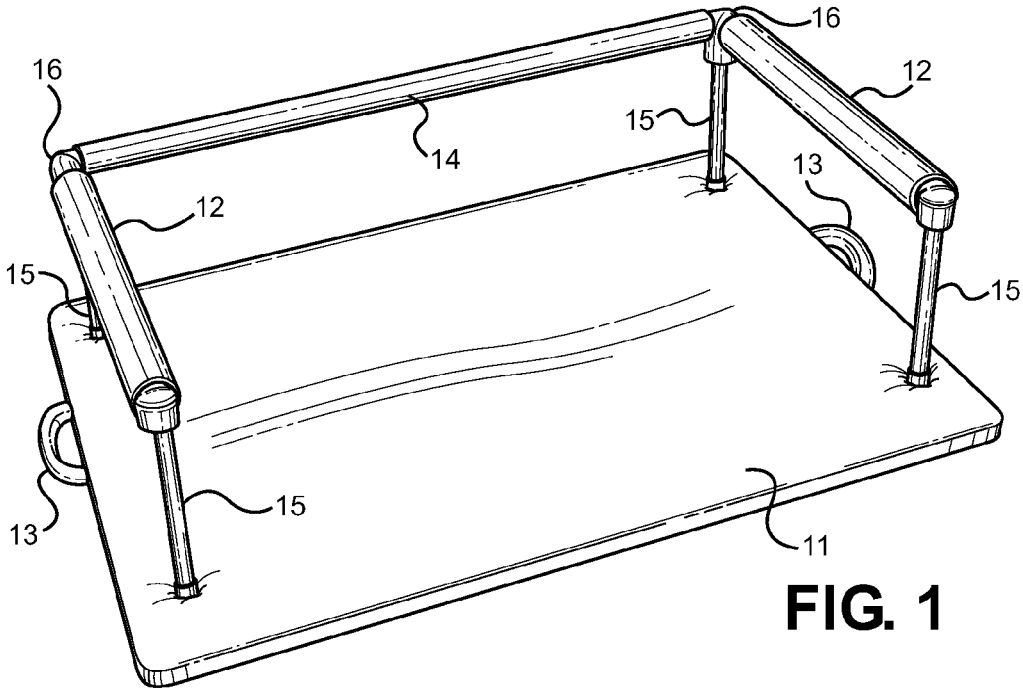

This application claims the benefit of U.S. Provisional Application No. 61/497,573 filed on Jun. 16, 2011, entitled "Baby Walk Around."

BACKGROUND OF THE INVENTION

1. Field of the Invention

The present invention relates to a device for assisting young children with learning to stand and walk. The device is highly portable, allowing parents to bring it along when the family goes to visit friends or relatives, or to play outside. The padded support rails and base provide a child with a stable, safe place to play while learning to walk.

The task of supporting a child while he or she learns to walk has posed a challenge parents and caregivers. Adults must be vigilant and watch over a child while in the home or outdoor environment, making sure that steady objects are available for the child to use for balance. A baby who is learning to take his or her first steps may grab couches, chairs, various household furniture, and even pets. Parents have become creative over the years at crafting safe trails of graspable objects that children can use for balance while walking. However, problems arise when the family goes on the road, goes outside or when the child is not carefully monitored while inside the home. Objects of appropriate height and stability may be lacking in the surrounding environment, or further still interior objects such as hard furniture may post a risk to a child given their lack of motor skills and their tendency to easily fall over. Hard objects or corners of furniture utilized as support can then become an impact hazard for the falling child. These items, and the lack of such support while away from the home, provide a child with an environment lacking in suitable or safe support for practicing his or her burgeoning motor skills. A portable play environment is therefore desired that provides children learning to walk with a safe, comfortable, and stable area to stand up and walk along, while also providing a readily portable assembly that improves transporting the device to areas away from the home.

2. Description of the Prior Art

The present invention provides safety and stability to young children learning to stand up and walk. Children can use the padded rails to pull themselves up, to lean on and to assist with establishing balance. The invention is easily collapsible into a self-contained portable unit with handles for easy asportation by a parent or caregiver. Devices currently known in the portable walking assistant art do not recite the same structural elements as the present invention and thus do not provide it's advantages to a user.

Some portable play devices comprise a complete enclosure with four sides, mesh netting walls and a foldable bottom. These devices, such as the exemplary invention disclosed by Welsh, Jr., U.S. Pat. No. 6,421,850 are essentially collapsible playpens. The supporting frame is permanently affixed to the base, unlike the present device, which provides a support structure that can be completely disassembled for ease of transport. When portable playpens are collapsed they remain bulky and cumbersome to carry. The base folds up and is pressed in between two sidewalls, resulting in a large, unwieldy shape. Conversely, the present invention has a base that folds in half and creates a pocket for a user to carry the disassembled support structure in.

A similar device is taught by Yang et al U.S. Pat. No. 6,343,390, which describes a foldable support structure for a play yard. Yang differs from Welsh in that the support bars of Yang are individually foldable. Yang comprises a skeleton of support bars, secured to form a cube-like shape. Each support bar is formed from two bars joined at the middle by a folding joint. This structure allows the device to fold into a more compressed shape than standard portable playpens such as that of Welsh. Though it's structure makes Yang easier to manipulate it still suffers from the drawback that its structural elements are permanently affixed.

Monaghan, U.S. Pat. No. 7,713,175 discloses another skeletal frame device. A It comprises an upper rectangular frame, a lower rectangular frame having a larger width than the upper frame, and four support posts that join the upper and lower rectangular frame together. In use a child is placed within the upper rectangular frame so that his or her hands rest on the frame, and the child then walks the length of the device, supported by the upper rectangular frame. The device of Monaghan is not collapsible, and the only method of compressing its volume is to disassemble the device. This makes it difficult to transport and potentially impossible to fit in a small or mid-size car. The Monaghan invention is thus impracticable for travelling families.

The devices of Welsh, Yang, and Monaghan all provide four supports that encircle a walking child. This makes it more difficult to place a child in the device because he or she must be carefully manipulated between the supports. The present invention has one open side allowing for easy placement and removal of a child within the device.

Starks, et al, U.S. Pat. No. 4,902,000 describes a child walking trainer that comprises two handle bars secured to a base by telescoping support bars. The height of the handlebars can be increased or decreasing by extending or lowering the support bars. The bars are secured to the base by u-shaped clamps that removably secure to the side of the base. Securement by such means is problematic because a stumbling child can knock the clamp off the side of the mat, causing the handle bar to collapse. The present invention solves this problem and provides a more stable structure by removably securing the support legs through apertures in the base mat, making the support legs harder to knock out of position and decreasing the likelihood that a child will fall due to failing supports.

The prior art fails to disclose an easily collapsible children's walking trainer that is structurally sound enough to withstand stumbling children, but portable enough to be convenient for travel use. The present invention provides an easy to disassemble and collapse walking trainer that can be carried to a variety of locations. It is not bulky, cumbersome or prohibitively large, making it ideal for use in areas outside the home. It substantially diverges in design elements from the prior art and consequently it is clear that there is a need in the art for an improvement to existing devices. In this regard the instant invention substantially fulfills these needs.

SUMMARY OF THE INVENTION

In view of the foregoing disadvantages inherent in the known types of walking training devices now present in the prior art, the present invention provides a new easily portable child walking trainer, wherein the same can be utilized for providing convenience for the user when travelling with a child who is learning to stand or walk. It comprises three support rails that are removably securable to a base mat. The support rails form a U-shape when the device is assembled, making it easy for parents to insert and remove children from the play area. Both the support bars and base mat are padded to increase safety and comfort of a child user. When the device is in use, a child can play on the mat, lean on the support rails, or use them for balance while practicing walking. The device can then be easily disassembled, its parts placed on the base mat, the base mat folded in half, and the device carried away by handles located at either end of the base mat. The invention is thus easily transportable, convenient to assemble and disassemble and safe for use by small children.

It is therefore an object of the present invention to provide a new and improved portable walking trainer device that has all of the advantages of the prior art and none of the disadvantages.

It is another object of the present invention to provide a device that can be rapidly assembled and disassembled, thereby promoting ease of deployment.

Another object of the present invention is to provide a device that is collapsible into one self-contained unit that can be carried by its handles.

Yet another object of the present invention is to provide a device that is safe for use by small children.

Still another object of the present invention is to provide a device that offers support for children learning to stand or walk, while still allowing the children freedom of movement.

A further object of the present invention is to provide a structurally static device that can support an unstable child and withstand general impacts of the child stumbling without risk of collapsing, and one that further does not include sharp or hardened areas that may otherwise pose a risk to a falling child.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 discloses an overhead perspective view of the fully assembled portable walking trainer device.

Figure 2:
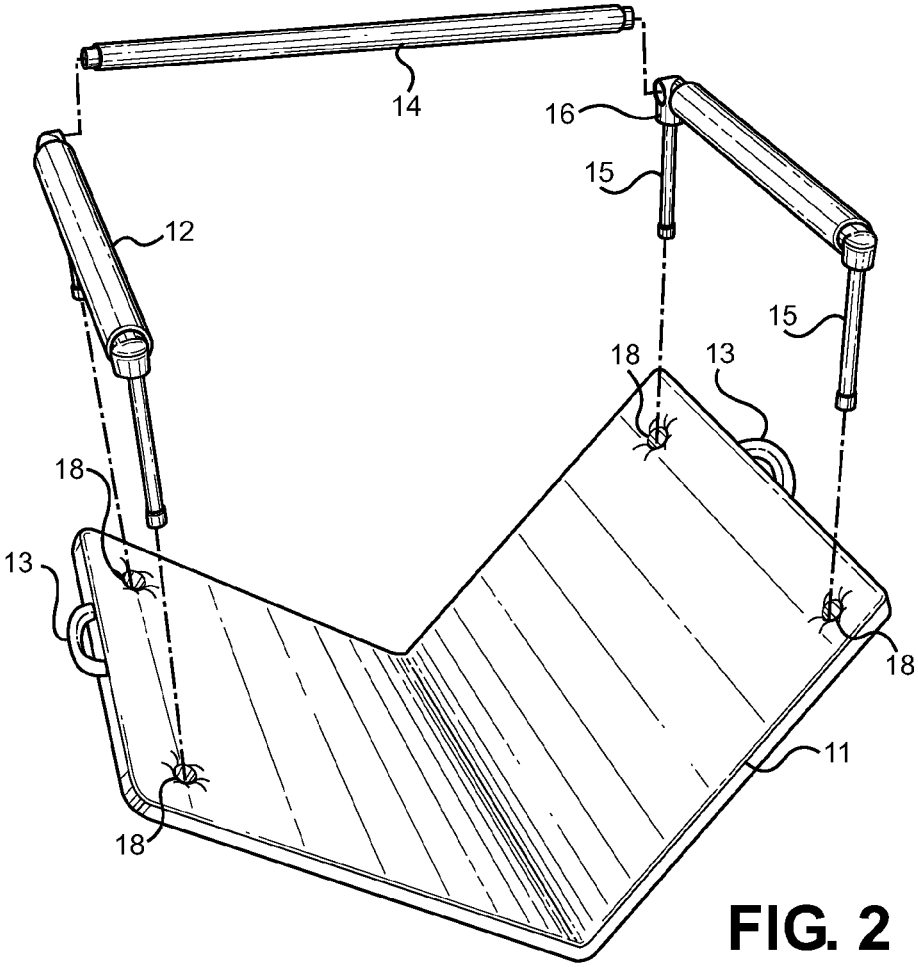

FIG. 2 discloses an overhead perspective view of the portable walking trainer device in the initial stages of disassembly.

Figure 3:
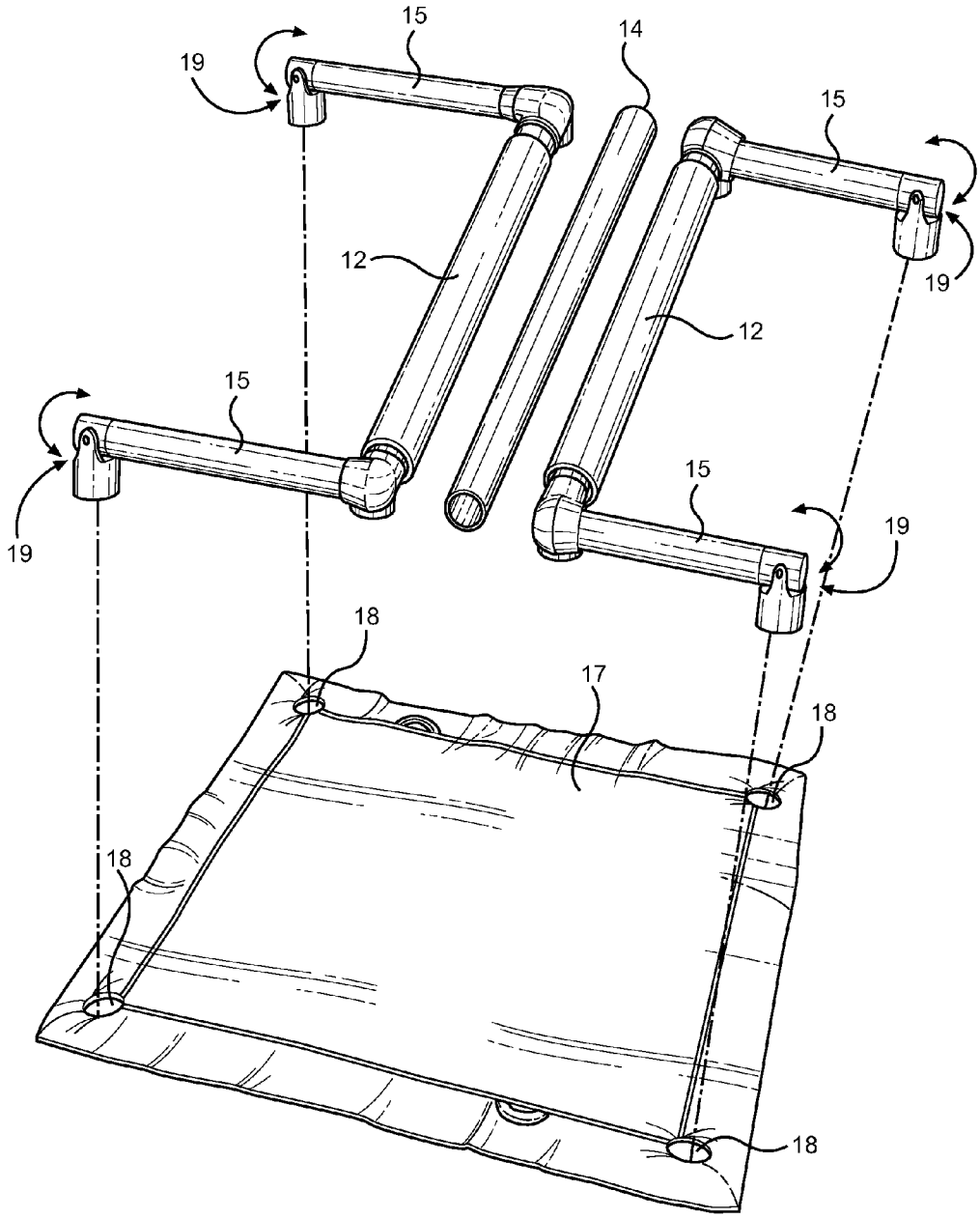
Figure 4:
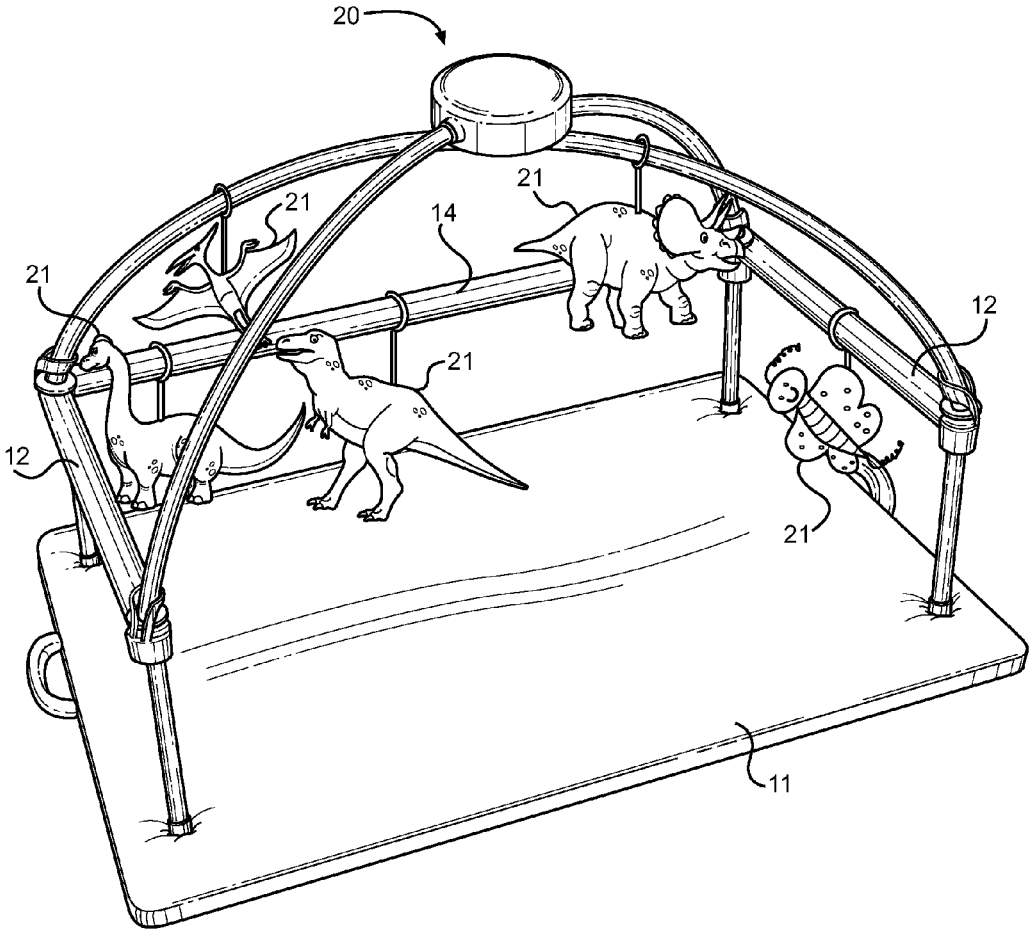

FIG. 3 discloses an overhead perspective view of the portable walking trainer device FIG. 4 discloses an overhead perspective view of an alternate embodiment of the portable walking trainer device with an overhead frame.

Figure 5A:
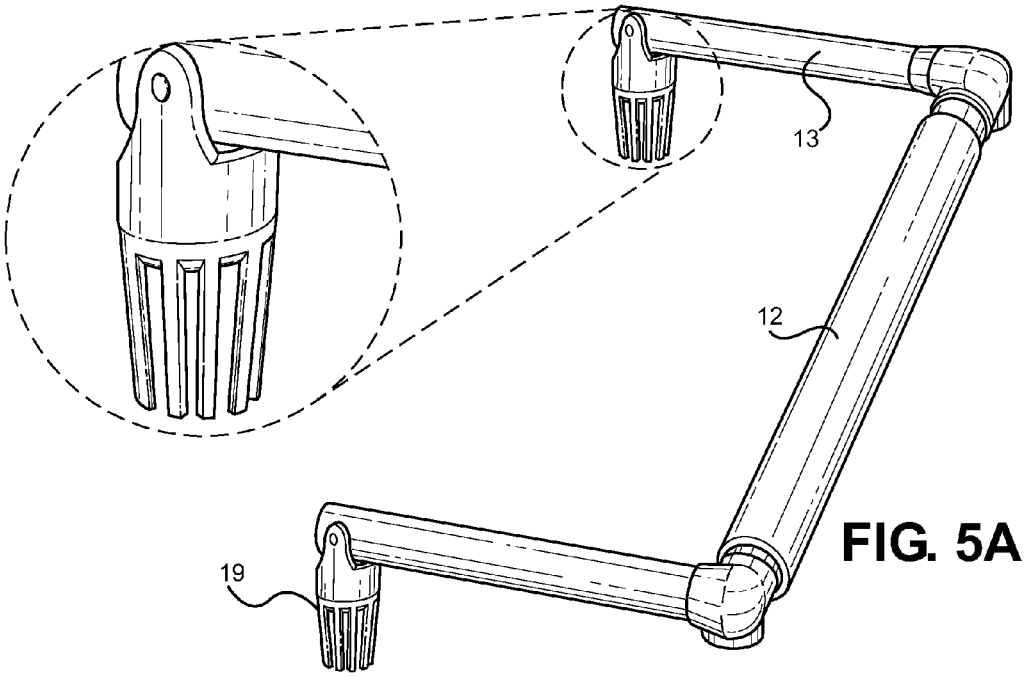

FIG. 5A discloses a perspective view of an alternative embodiment of a side support bar, having an interlocking connection means.

Figure 5B:
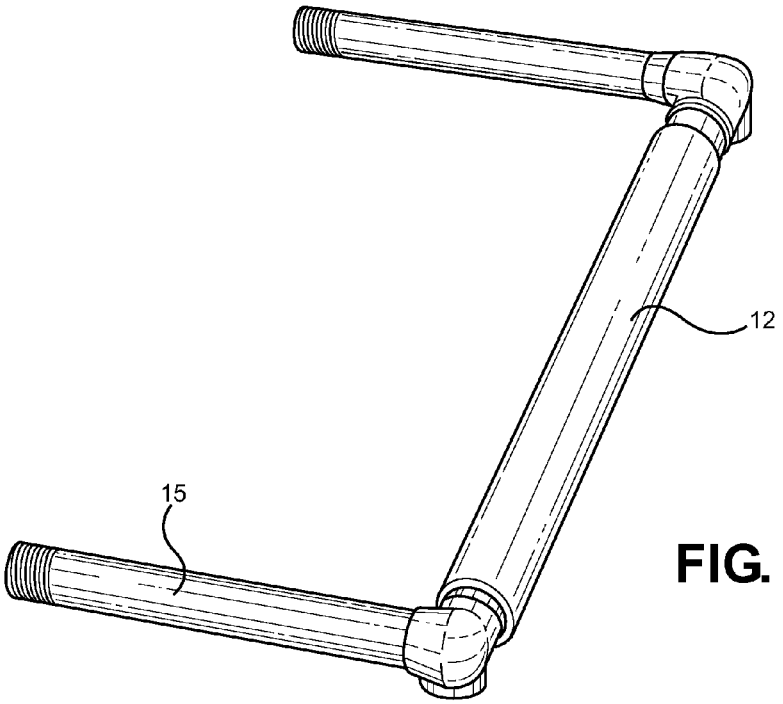

FIG. 5B discloses a perspective view of an alternative embodiment of a side support bar having a threaded connection means.

DETAILED DESCRIPTION OF THE INVENTION

Reference is made herein to the attached drawings. Like reference numerals are used throughout the drawings to depict like or similar elements of the portable walking trainer device. For the purposes of presenting a brief and clear description of the present invention, the preferred embodiment will be discussed as used for providing a portable means for assisting a child who is learning to stand or walk. The figures are intended for representative purposes only and should not be considered to be limiting in any respect.

Referring now to FIG. 1, there is shown a perspective view of the assembled portable walking trainer device. The device has a base mat 11 that provides stability to the structure and a place for a child to sit or stand comfortably. Handles 13 are disposed on either side of the base mat to facilitate convenient transportation of the device. Two lateral support bars 12 run along laterally opposing sides of the base mat and are secured thereto by two upstanding securing posts 15 on the ends each support bar. A rear support bar 17 extends across one of the remaining sides of the mat and is removably connected via perpendicular connector joints 16 to both lateral support bars. The assembled support bars form a U-shaped handrail structure that provides stability assistance to a child while leaving an area open so that parents or caregivers can easily access the child.

Referring now to FIG. 2, there is shown a perspective view of the device in the initial stage of disassembly. The lateral support bars 12 are unsecured removed from the base mat 11. In one embodiment the securing posts are simply inserted into apertures 18 in the base mat. The proportion of the securing posts are such that they fit snuggly within the apertures and are capable of withstanding general force applied by a playing child. Alternative embodiments include securing posts having pivotable securing cups, threaded or interlocking means for connecting with the base mat (see FIG. 3, FIG. 5A and FIG. 5B). The rear support bar 14 can be disconnected from the connector joints securing it to the lateral support bars. Once the support bar structures are removed, the base mat 11 can be folded in half, the various support bar pieces placed between the halves, and the handles 13 brought together, forming a self-contained easily portable unit. This stowed state will be greatly appreciated by parents who travel frequently with their children, or those who prefer the benefits of outdoor play. In an alternative embodiment, the base mat is constructed of two separate mat halves that are joined at the middle by a hinging bracket, permitting the halves to be folded together.

In FIG. 3 the device is an exploded view of the present invention in a stowed state. The base mat may be covered in a fabric covering, such as a blanket covering 17. Alternatively a blanket may be laid over the top of the base mat. This increases the comfort of a playing child by providing a softer surface to sit or stand upon. The support bars 12, 14 are shown in their stowed state and exploded from their securement to the mat 17 of the assembly. In this embodiment the securing posts 15 have pivot joints 19 disposed at their lower ends. The pivot joints connect to the apertures 18 in the base mat and the securing posts can then be rotated between a vertical and horizontal position when deploying or stowing the assembly. Release of the pivot joint 19 securement can also be affected to in this embodiment, although it is preferred that the assembly be folded together within the folded mat interior when stowed, reducing loose parts and stowing the assembly together. When stowing the assembly as shown using the pivot joints 19, the rear support bar 14 is removably from the lateral support bars 12 to allow rotation of the side railing portions.

Turning now to FIG. 4, there is shown an exemplary embodiment of the assembled invention. In this embodiment an overhead frame 20 having a dome-like shape is secured to the support bars 12, 14. The overhead frame removably secures to the ends of the forward ends of the lateral support bars and the connection joint between the lateral support bars and rear support bar. Four frame supports arch above the device to great a dome-shaped structure. Toys 21 can be hung from the overhead frame or the support bars to create visually engaging items for a child to play with. A child's desire to reach the hanging toys or disengage them from the support bars or overhead frame can inspire the child to attempt standing or walking, thus facilitating improvement of a child's motor skills.

In FIGS. 5A and 5B there are shown two alternative embodiments of the support bar 12 and securing posts 15. The embodiment shown in 5A shows depressible interlocking pivotable cups secured to the lower ends of the securing posts. The sides of the cups are depressed during insertion into the base mat (not shown) of the device and expand after insertion to prevent removal of the securing post from the aperture. The cups are depressed a second time to compress them for removal from the apertures during disassembly of the device. In another embodiment the securing posts may be threaded along their lower ends. Apertures in the base mat (not shown) are also threaded to permit the securing posts to be removably secured to the base mat by interlocking threading between the securing post and the interior of the aperture. These alternative embodiments provide stable connection means that assist in providing support to a child that uses the support bars for balance.

In use an individual carries the portable walking trainer device in the stowed state to a desired location. The device is then placed on the ground and unfolded so that the base mat lies flat. Lateral support bars are then displaced from their stowed position and held upright by a user while the lower ends of the attached securing posts are inserted into apertures in the base mat. Opposing ends of the rear support bar are then inserted into connection joints at corresponding ends of the lateral support bars. The device is assembled and forms a base mat with a U-shaped structure of handrails. A parent or caregiver places the child on the mat within arm's reach of a support bar. Hanging toys may be added to the bars to provide sensory stimulation to the child.

The present invention assists young children in learning to stand and walk. It provides a U-shaped structure of handrails that a child can lean on, use to pull himself upright, or fall upon if necessary. The support bars are covered in a soft padding such as foam. The padding should be durable and impact absorbent to reduce the risk of injury to children using the device. A fabric layer may be used to cover the foam, providing a washable and aesthetically pleasing exterior covering for the support bars. The base mat likewise may be constructed of a strong core material such as wood or plastic, and then covered in foam padding to soften impacts. Alternatively the base mat may be constructed of a durable foam or foam-like material all the way through the mat. A fabric covering may be used to cover any embodiment of the base mat.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable walking trainer device for a child, comprising:

a base mat;

two lateral support bars, each of said support bars being connected to a plurality of upstanding securing posts;

a rear support bar that is removably securable to said lateral support bars;

a plurality of apertures disposed along the perimeter of said base mat, wherein said securing posts engage said apertures to form a removable securement of said lateral support bars to said base mat;

said lateral and rear support bars form U-shaped railing structure above said mat.

2. The device of claim 1, further comprising handles disposed on laterally opposing sides of said base mat.

3. The device of claim 1, wherein said securing posts have further comprise pivot joints at their base, facilitating said lateral members and securing posts to be rotated against said mat surface from their securement apertures after separation of said rear support bar.

4. The device of claim 1, wherein said securing posts have, depressible locking cups secured to one end, wherein said depressible locking cups engage with said apertures to form removable securement between said lateral support bars and said base mat.

5. The device of claim 1, wherein said securing posts have threading disposed at an end for forming a removable engagement with said apertures.

6. The device of claim 1, wherein said base mat may be folded in half to create a carrying compartment for said lateral and rear support bars.

7. The device of claim 1, wherein one portion of said base mat perimeter is open, without any support bars positioned along the length of said portion.

8. A portable walking trainer device for a child, comprising:

a base mat;

two lateral support bars, each of said support bars being connected to a plurality of upstanding securing posts;

a rear support bar that is removably securable to said lateral support bars;

a plurality of apertures disposed along the perimeter of said base mat, wherein said securing posts engage said apertures to form securement of said lateral support bars to said base mat;

said lateral and rear support bars form U-shaped railing structure above said mat;

said securing posts have further comprising pivot joints at their base, facilitating said lateral members and securing posts to be rotated against said mat surface from their securement apertures after separation of said rear support bar.

9. The device of claim 8, further comprising handles disposed on laterally opposing sides of said base mat.

10. The device of claim 8, wherein said securing posts have, depressible locking cups secured to one end, wherein said depressible locking cups engage with said apertures to form removable securement between said lateral support bars and said base mat.

11. The device of claim 8, wherein said securing posts have threading disposed at an end for forming a removable engagement with said apertures.

12. The device of claim 8, wherein said base mat may be folded in half to create a carrying compartment for said lateral and rear support bars.

13. The device of claim 8, wherein one portion of said base mat perimeter is open, without any support bars positioned along the length of said portion.

* * * * *